United States Patent [19]

McDonald et al.

[11] 4,044,208

[45] Aug. 23, 1977

[54] TWO-PART ELECTRICAL CONNECTORS AND ELECTRICAL INTERLOCKS INCLUDING THEM

[75] Inventors: Thomas V. McDonald, Cheltenham; Stephen D. Witts, Prestbury, both of England

[73] Assignee: Smiths Industries Limited, London, England

[21] Appl. No.: 585,424

[22] Filed: June 9, 1975

[30] Foreign Application Priority Data

June 12, 1974 United Kingdom ..... 26177/74

[51] Int. Cl.[2] ..... H01R 33/30

[52] U.S. Cl. ..... 200/51.09; 339/19

[58] Field of Search ..... 339/19, 111, 255 RT, 339/222, 188 C; 200/51 R, 51.09; 317/11 E; 367/114, 112

[56] References Cited

U.S. PATENT DOCUMENTS

| | | | |
|---|---|---|---|
| 1,553,711 | 9/1925 | Myers | 339/255 RT |
| 2,555,689 | 6/1951 | Gehlsen et al. | 317/11 E |
| 2,594,004 | 4/1952 | Farish, Jr. | 339/188 C |
| 3,270,267 | 8/1966 | Nolte, Jr. | 200/51.09 |
| 3,618,065 | 11/1971 | Trip et al. | 339/19 |

FOREIGN PATENT DOCUMENTS

| | | | |
|---|---|---|---|
| 1,119,671 | 4/1956 | France | 200/51.09 |
| 2,038,409 | 4/1971 | Germany | 339/19 |

*Primary Examiner*—David Smith, Jr.

*Attorney, Agent, or Firm*—Pollock, Van deSande & Priddy

[57] ABSTRACT

A two-part electrical connector for connecting a cable from a cathode-ray tube to an E.H.T. power-supply unit is incorporated in a safety interlock which ensures that E.H.T. is applied to the female part of the connector mounted on the unit only while the male connector part on the cable, is fully mated with the female part. Application of E.H.T. to the female part is controlled by a switching device that is operated via an interlock circuit only when two pins on the female part are bridged electrically by contact under a resilient-wire loop carried by the male part. The loop is sprung onto an electrically-insulative collar that embraces coaxially a tubular nose of the male part, and the pins project at diametrically-opposed positions through a flange of a tubular guideway of the female part. The pins enter slots in the collar and abut the wire within the loop such as to maintain the interlock circuit closed and apply E.H.T. to the female part, only so long as the nose is inserted in the guideway and the main connection-path remains established through the connector between a contact-pin at the end of the guideway of the female part and a metal insert within the nose of the male part.

11 Claims, 3 Drawing Figures

TWO-PART ELECTRICAL CONNECTORS AND ELECTRICAL INTERLOCKS INCLUDING THEM

This invention relates to two-part electrical connectors and electrical interlocks including them.

It is sometimes necessary or desirable to ensure that electrical supply to a two-part electrical connector is broken whenever the two parts of the connector are disengaged from one another. There are various ways in which an interlock involving the connector can be provided to achieve this. More particularly, the connector may be provided with mating plug and socket elements additional to those required to establish the desired electrical connection-path or -paths through the connector, any break in engagement between the additional plug and socket elements being used to signify disengagement of the two connector parts from one another and bring about the desired break in supply to the connector. Alternatively, a device such as a microswitch may be mounted on the connector to respond to the mechanical disengagement of the two parts from one another, but in either case there are practical problems of ensuring that the supply to the connector is broken without undue delay during disengagement.

The need to avoid undue delay in operation of the interlock is of especial importance where high-voltage supply to the connector is involved, since otherwise there is the danger of arcing within the connector during disengagement. Furthermore, the provision of additional plug and socket elements in a connector, or the incorporation of a microswitch, is in general costly, and in the former case may lead to difficulties of ensuring adequate electrical isolation from the main path or paths through the connector if substantial increase in size of the connector is to be avoided.

It is an object of the present invention to provide a form of two-part electrical connector, and an interlock including such connector, that may be used to reduce these disadvantages.

According to the present invention there is provided a two-part electrical connector that comprises two parts that are engageable with one another in a mating relationship to establish electrical interconnection through the connector, wherein an electrical conductor-element is carried by a first of the said two parts, and two electrical contact-elements are mounted with the said second part to abut the said conductor-element, so that the two contact elements are thereby bridged electrically by said conductor element, when the said first and second parts are engaged with one another in said mating relationship.

The conductor-element carried by the first part of the connector may be in the form of a loop of resilient wire, and the two contact-elements mounted with the second part may be electrically-conductive pins. Where pins, together with a resilient-wire loop, are provided such pins may be arranged to engage with the wire at spaced positions from one another within the loop. Such an arrangement is of especial advantage in enabling an electrical interlock facility incorporating the connector, to be provided without undue complication and expense.

The connector of the present invention (whether or not incorporating the specific features referred to in the preceding paragraph) is applicable generally to the provision of an electrical interlock of improved form. In this connection the present invention in accordance with this provides an electrical interlock comprising the connector together with electrical circuit means that is coupled to the two contact-elements to provide an electrical circuit that is closed only when the two contact elements are bridged.

The interlock of the invention is particularly, though not exclusively, applicable to E.H.T. power-supply arrangements where connection is to be established by cable to an E.H.T. unit. In these circumstances the two-part electrical connector may serve principally to intercouple the cable with the unit, one of the two parts of the connector being mounted on the unit and the other on the cable so that the said electrical circuit through the contact-elements is closed only when the cable is coupled to the unit. The circuit may include, or may otherwise control, a switch device that serves to break supply of E.H.T. to the unit-mounted connector-part unless the circuit is closed, that is to say, while the cable remains uncoupled from the unit.

A two-part electrical connector and an electrical interlock including the connector, in accordance with the present invention will now be described, by way of example, with reference to the accompanying drawings, in which.

The two-part connector and the interlock to be described are for use in the supply of E.H.T. to a cathode-ray tube.

Figure 1:
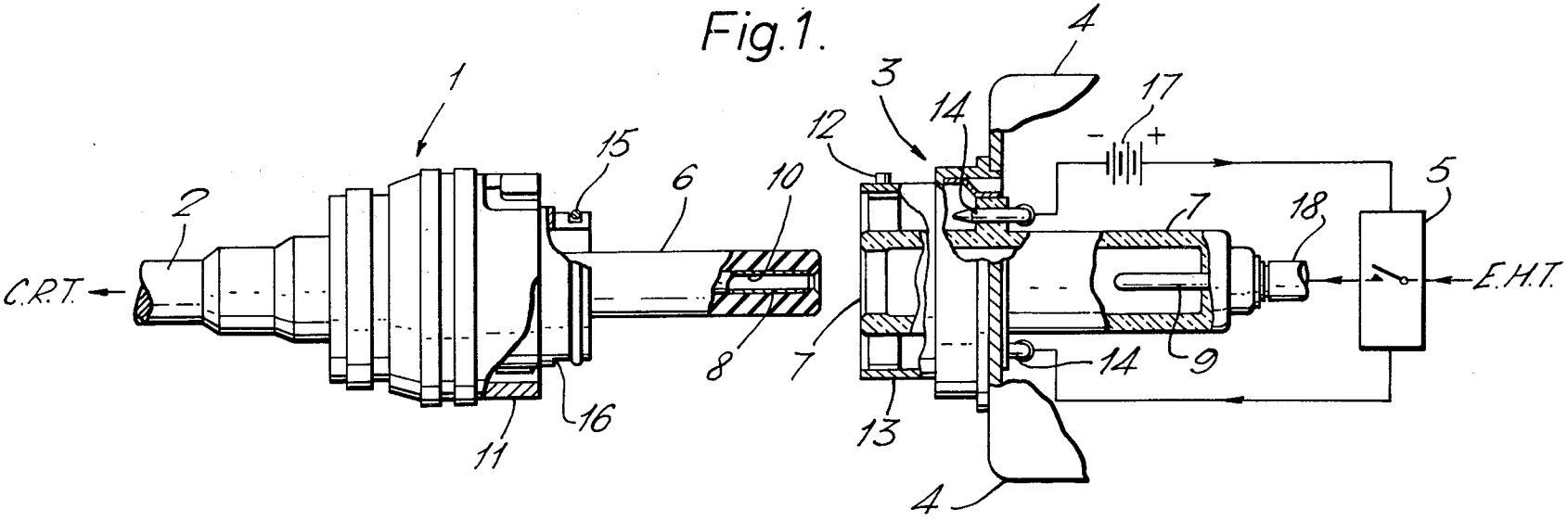
FIG. 1 is a side elevation of the two-part electrical connector showing the two parts unmated and illustrating the electrical interlock of which the connector forms part.

Referring more particularly to FIG. 1, a first, male part 1 of the connector is coupled to an E.H.T. cable 2 leading to the cathode-ray tube, whereas the second, female part 3 of the connector is mounted on an E.H.T. supply unit 4 to receive the male part 1 and thereby establish the supply connection. It is the purpose of the interlock to ensure that E.H.T. is supplied within the unit 4 to the female part 3 only so long as the male part 1 is fully mated with the female part 3. In this respect, the unit 4 includes a switching device 5 that breaks the supply of E.H.T. to the female part 3 until full mating is accomplished.

Mating of the male part 1 with the female part 3 involves insertion of an elongate tubular nose 6 of the male part 1 deeply into a tubular guide 7 of the female part 3. This establishes electrical connection of a metal insert 8 in the nose 6 with a metal pin 9 that projects axially from the far end of the guide 7 so as to enter tightly a bore 10 of the insert 8. A metal bayonet-cap 11 is provided on the male part 1 for engaging with three symmetrically-spaced pins 12 on a metal collar 13 of the female part 3 in retaining the parts 1 and 3 tightly mated together.

Figure 3:
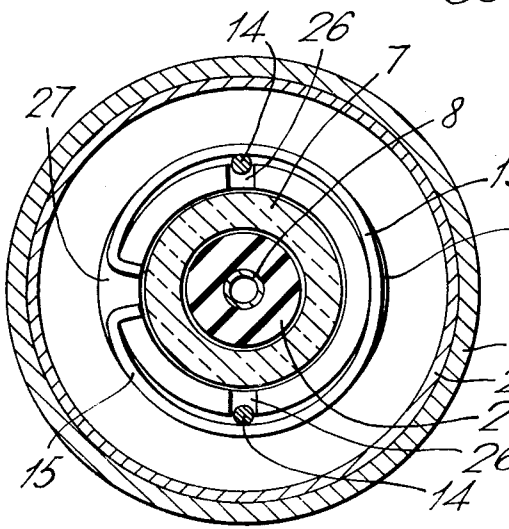
FIG. 3 is a section through the connector taken on the line III—III of FIG. 2.

As the male and female parts 1 and 3 are finally brought together and secured in the full mating condition by engagement of the bayonet-cap 11 with the pins 12, two diametrically-opposed pins or electrical contacts 14 on the female part 3 are entered under a resilient-wire loop 15. The loop 15, which embraces an electrically-insulative collar 16 of the male part 1 (as indicated more clearly in FIG. 3), bears hard on both pin-contacts 14 and thereby bridges them electrically. This interconnection of the two pin-contacts 14 via the loop 15 completes the electrical circuit of the interlock. This circuit includes a low-voltage source 17 that is connected within the unit 4 in series with the switching device 5 across the contacts 14. Completion of the interlock circuit via the loop 15 causes operation of the switching device 5 to establish supply of the E.H.T. via a cable 18 to the female part 3.

Withdrawal of the male part 1 from the female part 3, following disengagement of the bayonet cap 11 from the pins 12, withdraws the loop 15 from the contacts 14 and thereby breaks the interlock circuit. The switching device 5 responds to this accordingly, to break E.H.T. supply to the cable 18 and therefore to isolate the female part 3 from E.H.T. More particularly the interlock circuit breaks before the interconnection of the cables 2 and 18 through the connector is broken. To this end, the pin 9 is of such a length that disconnection of the insert 8 from the pin 9 by the withdrawal of the male part 1, is not fully accomplished until after the loop 15 has left the pin contacts 14. In this way it is ensured that the switching device 5 has adopted its unoperated state, and the female part 3 has thus become isolated from E.H.T., before there is any break in the main connection through the connector, and exposure (albeit deep within the guide 7) of the pin 9.

The female part 3 remains isolated from E.H.T. until the male part 1 is again inserted and electrical interconnection of the cables 2 and 18 is re-established by engagement of the insert 8 with the pin 9. The switching device 5 operates to re-establish E.H.T. supply to the cable 18 only when the pins 14 have entered beneath the loop 15 at the end of the insertion, and the bayonet cap 11 has engaged the pins 12 to secure the male part 1 and female part 3 tightly together as illustrated in FIG. 2.

Figure 2:
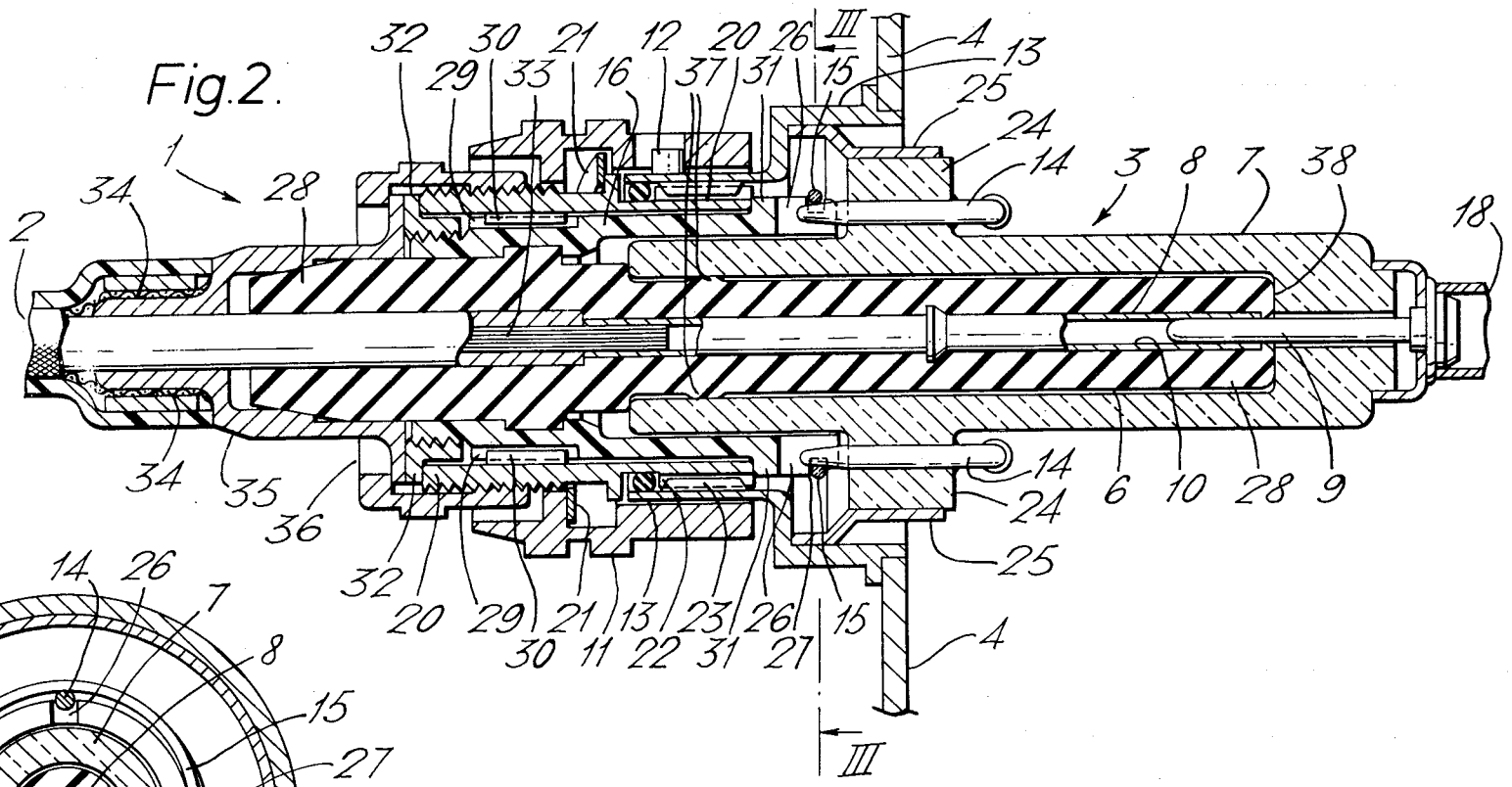
FIG. 2 is a sectional side elevation of the two-part electrical connector of FIG. 1 to an enlarged scale and showing the two parts of the connector mated together.

Referring now more particularly to FIG. 2, the bayonet cap 11 is carried on a metal shell 20 of the male part 1 with a spring washer 21 trapped between them to provide resilience in the engagement of the cap 11 with the pins 12 of the collar 13. The shell 20 enters the collar 13 with an alignment determined by cooperation of a key 22 on the shell 20 with a keyway 23 of the collar 13.

The collar 13 is soldered to the casing of the unit 4, and the tubular guide 7, which is of ceramic material and has an intermediate circumferential flange 24, is secured coaxially within the collar 13 by means of a brazed ring 25. The pins 14 are mounted to project through the flange 24 and thence (as illustrated more clearly in FIG. 3) into respective slots 26 in the periphery of the electrically-insulative collar 16, for entry beneath the loop 15. The loop 15, of a beryllium-copper alloy and gold plated, is sprung into a circumferential groove 27 of the collar 16.

The collar 16 is retained coaxially on an elongate moulding 28 of silicone rubber that projects forwardly from the collar 16 to provide the nose 6. The shell 20 surrounds the collar 16, angular displacement between them being restrained by keys 29 on the shell 20 that engage in keyways 30 of the collar 16. Axial displacement between them is also restrained by the trapping of the shell 20 between a lip 31 at one end of the collar 16 and a bush 32 screwed onto the other end.

The core 33 of the cable 2 projects from within its metal sheath 34 to enter the rear of the moulding 28 and establish within it a solder connection with the insert 8. The sheath 34 is crimped to a metal ferrule 35 that is clamped to the rear of the moulding 28 under a flanged ring-cap 36 screwed onto the shell 20.

The moulding 28 is provided with a circumferential ridge 37 that is located on the nose 6 to lie past just within the mouth of the guide 7 when the male part 1 is fully mated with the female part 3. The ridge 37 is a close fit within the guide 7 so that the silicone rubber of the moulding 28 forms a very tight seal with the smooth inside surface of the ceramic guide. A correspondingly-tight seal is established at the end face 38 of the moulding 28 around the pin 9.

We claim:

1. In a two-part electrical connector that comprises two parts each of which has an electrical contact, the two parts being engageable with one another in a mating relationship to establish electrical interconnection of the two contacts through the connector, the improvement wherein the connector further includes an elongate electrical conductor-element carried by a first of said two parts, said elongate conductor-element being in the form of a resilient-wire loop, two electrical contact-elements, and means mounting the said two contact-elements with said second part to abut the said conductor-element at spaced positions along its length, so that the two contact-elements are thereby bridged electrically by said conductor element, when the said first and second parts are engaged with one another in said mating relationship.

2. A two-part electrical connector according to claim 1 wherein each of said electrical contact-elements is in the form of an electrically-conductive pin.

3. A two-part electrical connector comprising first and second parts each of which has an electrically-insulative portion and an electrical contact carried by said insulative portion, the said two parts being engageable with one another in a mating relationship to establish electrical interconnection of the two contacts through the connector, a loop of resilient electrically-conductive wire carried by said first part, said loop embracing the said electrically-insulative portion of said first part so that said wire is spaced outwardly in electrical insulation from the said contact of said first part, two electrically-conductive pins carried by said second part, and means mounting the said two pins on said second part to engage with said wire loop at spaced positions from one another within said loop when the said first and second parts are engaged with one another in said mating relationship, said pins being spaced from the said electrical contact of said second part to abut with said wire loop by entry into said loop beneath the wire so that the said pins are thereby bridged electrically by the wire of said loop.

4. A two-part electrical connector according to claim 3 wherein each of said two parts has a tubular member, the tubular member of one of said parts being insertable within the said tubular member of the other of said parts to engage said first and second parts with one another in said mating relationship, and wherein said connector includes means mounting the said loop on said first part to embrace its said tubular member.

5. A two-part electrical connector according to claim 4 wherein said means mounting the said loop is an electrically-insulative collar, said loop being sprung onto said collar and said collar having slots therein to receive the said pins under said wire.

6. An electrical interlock comprising: a two-part electrical connector that comprises two parts each of which has an axis of symmetry and an electrical contact fixed in position with respect to its axis, the two parts being engageable in axial alignment with one another in a mating relationship that establishes electrical interconnection of the two contacts through the connector, an elongate electrical conductor-element carried by a first of said two parts at a position spaced outwardly from the said contact of said first part with respect to the said axis of symmetry of said first part, said elongate conductor-element extending lengthwise in a plane transverse to the said axis of symmetry of said first part, two electrical contact-elements, and means mounting the said two contact-elements on said second part at positions spaced outwardly from the said contact of said second part with respect to the said axis of symmetry of said second part, said mounting means mounting said contact-element to abut the said conductor-element at spaced positions along its length, so that the two contact-elements are thereby bridged electrically by said conductor element when the said first and second parts are engaged with one another in said mating relationship; electrical circuit means coupled to the said two contact-elements to provide an electrical circuit that is closed only when the two contact-elements are bridged electrically; actuable means; and means for actuating said actuable means in response to the condition in which said electrical circuit is closed.

7. An electrical interlock according to claim 6 wherein said actuatable means includes switch means, and means for coupling an electrical supply source to the said contact of one of said parts through said switch means, thereby to energize said contact of said one of said parts from said electrical supply source only when said two contact-elements of said second part are bridged electrically by said elongate electrical conductor-element of said first part.

8. An electrical interlock according to claim 6 wherein said conductor-element is in the form of a resilient-wire loop.

9. An electrical interlock comprising: a two-part electrical connector that comprises first and second parts each of which has an electrically-insulative portion and an electrical contact carried by said portion, the two said parts being engageable with one another in a mating relationship to establish electrical interconnection of the two contacts through the connector, a loop of resilient electrically-conductive wire carried by said first part, said loop embracing the said electrically-insulative portion of said first part so that said wire is spaced outwardly in electrical insulation from the said contact of said first part, two electrically-conductive pins, and means mounting the said two pins with said second part to engage with the wire of said loop at spaced positions from one another within the loop when the said first and second parts are engaged with one another in said mating relationship, said pins being spaced from the said electrical contact of said second part to abut with said wire by entry into said loop beneath the wire so that the said pins are thereby bridged electrically by said wire; an electrical path for connection to one of said contacts; electrical switch means that is selectively energizable to connect said path to said one contact; and circuit means coupled between said electrically-conductive pins and said switch means to energize said switch means when said pins are bridged by said wire of said loop.

10. An electrical interlock according to claim 9 wherein each of said two parts of the connector has a tubular member, the tubular member of one of said parts being insertable within the said tubular member of the other of said parts to engage said first and second parts with one another in said mating relationship, and wherein said connector includes means mounting the said loop of wires on said first part to embrace its said tubular member.

11. An electrical interlock according to claim 10 wherein said means mounting the said loop of wire comprises an electrically-insulative collar, said loop being sprung onto said collar, and said collar having slots therein to receive the said pins under the loop.

* * * * *